US009815306B2

(12) United States Patent
Kanazawa et al.

(10) Patent No.: US 9,815,306 B2
(45) Date of Patent: Nov. 14, 2017

(54) INK-JET RECORDING APPARATUS

(71) Applicant: BROTHER KOGYO KABUSHIKI KAISHA, Nagoya-shi, Aichi-ken (JP)

(72) Inventors: Gakuro Kanazawa, Toyokawa (JP); Iwane Sano, Obu (JP); Tsuyoshi Ito, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/337,089

(22) Filed: Oct. 28, 2016

(65) Prior Publication Data

US 2017/0120630 A1 May 4, 2017

(30) Foreign Application Priority Data

Oct. 30, 2015 (JP) ..... 2015-214412

(51) Int. Cl.

| | |
|---|---|
| ***B41J 2/01*** | (2006.01) |
| ***B41J 13/00*** | (2006.01) |
| ***B65H 5/26*** | (2006.01) |
| ***B41J 11/00*** | (2006.01) |
| ***B41J 3/60*** | (2006.01) |

(52) U.S. Cl.

CPC ..... *B41J 13/009* (2013.01); *B41J 2/01* (2013.01); *B41J 3/60* (2013.01); *B41J 11/0045* (2013.01); *B65H 5/26* (2013.01)

(58) Field of Classification Search

CPC ..... B41J 2/01; B41J 13/009; B65H 5/26

See application file for complete search history.

(56) References Cited

U.S. PATENT DOCUMENTS

2010/0207321 A1 8/2010 Samoto et al.
2016/0145063 A1* 5/2016 Segers ..... B65H 5/36 271/225

FOREIGN PATENT DOCUMENTS

| | | | |
|---|---|---|---|
| JP | 10-87138 | A | 4/1998 |
| JP | 2004-250170 | A | 9/2004 |
| JP | 2010-208853 | A | 9/2010 |

* cited by examiner

*Primary Examiner* — Kristal Feggins
*Assistant Examiner* — Kendrick Liu
(74) *Attorney, Agent, or Firm* — Merchant & Gould P.C.

(57) ABSTRACT

There is provided an ink-jet recording apparatus including: a body including a first conveyance route; a recording unit; a switchback conveyance part; a first flap moving between a first state in which the first flap guides, to the switchback conveyance part, a sheet conveyed to one side in a first direction and a second state in which the first flap guides, from the first conveyance route to a second conveyance route, the sheet conveyed to the other side in the first direction; and second flaps moving between a third state in which the second flaps guide, to the switchback conveyance part, the sheet conveyed to one side in the first direction and a fourth state in which the second flaps guide, from the first conveyance route to the second conveyance route, the sheet conveyed to the other side in the first direction.

7 Claims, 8 Drawing Sheets

INK-JET RECORDING APPARATUS

CROSS REFERENCE TO RELATED APPLICATION

The present application claims priority from Japanese Patent Application No. 2015-214412 filed on Oct. 30, 2015, the disclosure of which is incorporated herein by reference in its entirety.

BACKGROUND

Field of the Invention

The present invention relates to an ink-jet recording apparatus configured to record an image on both surfaces of a sheet.

Description of the Related Art

There is conventionally known an ink-jet recording apparatus capable of performing both of single-side printing for recording an image on one surface of a sheet and both-side printing for recording images on both surfaces of a sheet.

In such a well-known ink-jet recording apparatus, an image is recorded on one surface (referred to as a "first surface") of a sheet conveyed through a first conveyance route to one side in a first direction, and the sheet is conveyed to a switchback conveyance part while being guided with a sheet guide member (a route switching part). The switchback conveyance part switches a conveyance direction of the sheet from one side in the first direction to the other side in the first direction. The sheet conveyed to the other side in the first direction enters a second conveyance route from the first conveyance route while being guided with the sheet guide member.

The sheet conveyed through the second conveyance route enters the first conveyance route so that image recording may be performed on an opposite surface (referred to as a "second surface") of the first surface of the sheet. The sheet, of which second surface has been subjected to the image recording, is conveyed to one side in the first direction, and then discharged from the first conveyance route.

The sheet guide member is rotatably supported, in the first conveyance route, by a support shaft extending in a second direction orthogonal to the first direction. Bringing the sheet conveyed through the first conveyance route to one side in the first direction into contact with the sheet guide member rotates the sheet guide member upward, thus allowing the sheet to be guided to the switchback conveyance part. When the sheet is conveyed to one side in the first direction in a state where a rear end (an upstream end at one side in the first direction) of the sheet is in contact with the sheet guide member, the sheet guide member rotates downward under its own weight. When the sheet is conveyed to the other side in the first direction by the switchback conveyance part in the state where the sheet guide member rotates downward, the sheet is guided by the sheet guide member to the second conveyance route.

SUMMARY

The sheet swells as ink adheres thereto. The swelled sheet has a curved state, for example, in which a center part in the second direction is convex upward greater than both ends in the second direction. The sheet with a great curve may cause the contact between itself and a carriage or the like, resulting in damage and/or a jam of the sheet. Further, the curve of the sheet may destabilize a position where the sheet makes contact with the sheet guide member, which may prevent the sheet guide member from rotating properly. For example, when the sheet conveyed to the other side in the first direction makes contact with the sheet guide member, the sheet is liable to rotate and lift the sheet guide member upward. This may cause the sheet to erroneously enter the first conveyance route, instead of entering the second sheet conveyance route.

The present teaching has been made in view of the above circumstances, and an object of the present teaching is to provide an ink-jet recording apparatus that stably guides a sheet along a first conveyance route and a second conveyance route.

According to an aspect of the present teaching, there is provided an ink-jet recording apparatus configured to jet an ink on a sheet, including:

a body including a first conveyance route through which the sheet is conveyed in a first direction;

a recording unit disposed in the body and configured to record an image on the sheet conveyed through the first conveyance route in the first direction;

a switchback conveyance part configured to selectively convey the sheet to one side or the other side in the first direction in the first conveyance route;

a first flap configured to move between a first state in which the first flap guides, to the switchback conveyance part, the sheet conveyed to the one side in the first direction and a second state in which the first flap guides, from the first conveyance route to a second conveyance route, the sheet conveyed to the other side in the first direction by the switchback conveyance part; and second flaps disposed to sandwich the first flap in a second direction intersecting with the first direction and configured to move between a third state in which the second flaps guide, to the switchback conveyance part, the sheet conveyed to the one side in the first direction and a fourth state in which the second flaps guide, from the first conveyance route to the second conveyance route, the sheet conveyed to the other side in the first direction by the switchback conveyance part, wherein a portion of the first flap making contact with the sheet conveyed through the first conveyance route to the one side in the first direction is a first contact portion; a portion of each second flap making contact with the sheet conveyed through the first conveyance route to the one side in the first direction is a second contact portion; and the first contact portion is positioned on the other side in the first direction of each second contact portion;

a portion of each second flap making contact with the sheet conveyed to the other side in the first direction by the switchback conveyance part is a third contact portion; a portion of the first flap making contact with the sheet conveyed to the other side in the first direction by the switchback conveyance part is a fourth contact portion; and each third contact portion extends toward the second conveyance route beyond the fourth contact portion.

In the above configuration, when the sheet, of which first surface has been subjected to image recording using ink by the recording unit, is conveyed through the first conveyance route to one side in the first direction, the sheet makes contact with the first contact portion of the first flap. For example, when the center of the sheet in its width direction swells upward due to moisture of the ink, the swelled portion is pressed downward by being brought into contact with the first contact portion of the first flap. The first flap is disposed between the second flaps arranged in the second direction intersecting with the first direction. The second contact portions of the second flaps have no contact with the sheet at the point at which the first contact portion makes contact with the sheet. Thus, both ends of the sheet in the width direction are pressed outward by pressing the center of the sheet downward with the first contact portion.

The sheet conveyed to the other side in the first direction by the switchback conveyance part is guided to the second conveyance route by the fourth contact portion of the first flap in the second state and the third contact portions of the second flaps in the fourth state. In this case, since the third contact portions of the second flaps extend toward the second conveyance route beyond the fourth contact portion of the first flap, the both ends of the sheet in the width direction guided by the third contact portions are conveyed to the second conveyance route more easily than the center of the sheet guided by the fourth contact portion. Thus, even when the both ends of the sheet in the width direction have curves, the sheet is stably guided from the first conveyance route to the second conveyance route.

According to the present teaching, the sheet is stably guided by the first flap and the second flaps.

DESCRIPTION OF THE EMBODIMENTS

In the following, an explanation will be made about an embodiment of the present teaching with reference to drawings as appropriate. It is needless to say that the embodiment to be explained below is merely an example of the present teaching, and it is possible to appropriately change the embodiment of the present teaching without departing from the gist and scope of the present teaching.

Figure 1:
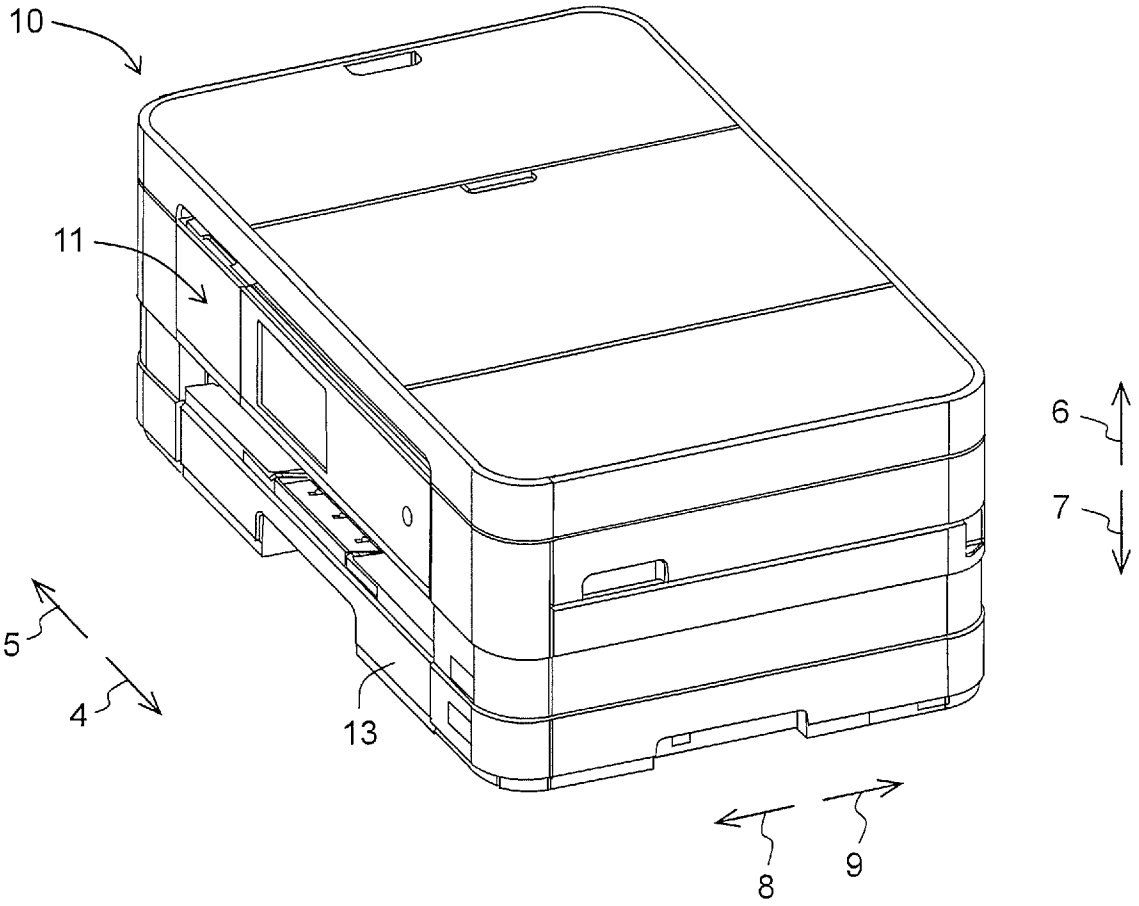
FIG. 1 is a perspective view of a multifunction peripheral 10 which is an example of an embodiment of the present teaching.

A multifunction peripheral 10 (an exemplary ink-jet recording apparatus) depicted in FIG. 1 has various functions including, for example, a printer function, a facsimile function, and a copy function. The multifunction peripheral 10 has a main apparatus body 11 that is formed in a substantially rectangular parallelepiped shape, and a feed tray 13 that is detachable with respect to a lower portion of the main apparatus body 11.

In the following explanation, an upper direction 6 (upward, upper side), a lower direction 7 (downward, lower side), a front direction 8 (frontward, front side), a rear direction 9 (rearward, rear side), a right direction 4, and a left direction 5 are defined on the basis of the state of FIG. 1 in which the multifunction peripheral 10 is installed usably.

Figure 2:
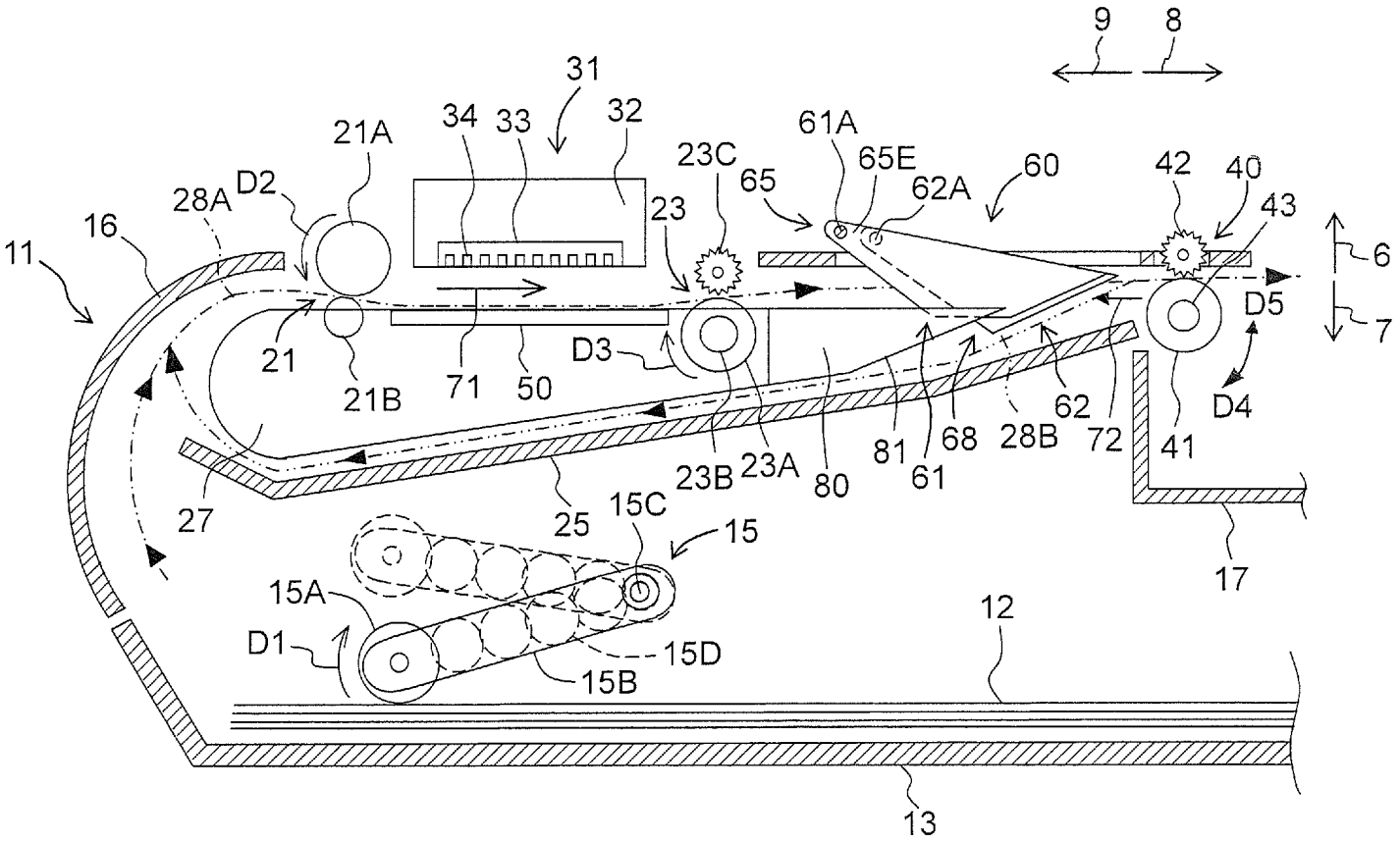
FIG. 2 is a schematic diagram illustrating a configuration of the multifunction peripheral 10.

As depicted in FIG. 2, the feed tray 13 accommodates stacked recording sheets 12 (each of the recording sheets 12 is an exemplary "sheet") on which an image is to be recorded. The feed tray 13 may be drawn frontward in the state depicted in FIG. 1 in which the feed tray 13 is installed to the main apparatus body 11.

In this embodiment, the feed tray 13 accommodates, for example, regular paper sheets of A4 size in such a manner that the long sides thereof extend in the front direction 8 and the rear direction 9. The regular paper sheet of A4 size is an example of the recording sheet 12. The recording sheet 12 of A4 size accommodated in the feed tray 13 is conveyed through a first conveyance route 28A provided in the main apparatus body 11.

The recording sheet 12 is conveyed through the first conveyance route 28A, on the basis of a center line (hereinafter referred to as a center alignment line 73, see FIG. 4) extending in a direction orthogonal to a conveyance direction, in such a manner that the center of a long side or short side of the recording sheet 12 meets or is coincident with the center alignment line 73. In the following, the case in which the recording sheet 12 is conveyed on the basis of the center alignment line 73 is referred to as "center alignment" or "center positioning". A direction, of the recording sheet 12, orthogonal to the conveyance direction is referred to as a "width direction".

As depicted in FIG. 2, an ink-jet type recording unit 31 that records an image on the recording sheet 12 is provided on the upper side of the main apparatus body 11. A platen 50 supporting the recording sheet 12 is provided below the recording unit 31. The recording unit 31 records the image on the recording sheet 12 supported on the platen 50.

A feed unit 15, which feeds each recording sheet 12 accommodated in the feed tray 13 to the first conveyance route 28A, is provided between the platen 50 and the feed tray 13. A feed guide member 16, which guides the recording sheet 12 fed from the feed tray 13 by use of the feed unit 15 to the recording unit 31, is provided at a rear end of the main apparatus body 11. The feed guide member 16 is curved in an arc shape that is convex in the rear direction 9. An inner circumference surface of the feed guide member 16 defines an upstream part of the first conveyance route 28A through which the recording sheet 12 is conveyed.

The feed unit 15 includes a feed roller 15A that feeds each recording sheet 12 accommodated in the feed tray 13 to the first conveyance route 28A. The feed roller 15A is rotatably supported by a first end (a tip end) of a support arm 15B in a state where a shaft line of the feed roller 15A extends in the right direction 4 and the left direction 5. A second end (a base end) of the support arm 15B is rotatably supported by a support shaft 15C of which shaft line is parallel to the shaft line of the feed roller 15A.

Rotating the support arm 15B around the support shaft 15C in the lower direction 7 brings the feed roller 15A into contact with an uppermost recording sheet 12 accommodated in the feed tray 13. Rotating the support arm 15B around the support shaft 15C in the upper direction 6 separates the feed roller 15A from the recording sheet 12. Power of an unillustrated motor transmitted by a power transmission mechanism 15D rotates the feed roller 15A in a direction indicated by an arrow D1 in FIG. 2. Rotating the feed roller 15A in a state where the feed roller 15A is in contact with the recording sheet 12 conveys the recording sheet 12 to the first conveyance route 28A. The sheet 12 fed from the feed tray 13 is conveyed through the first conveyance route 28A on the basis of center alignment while being guided by the feed guide member 16.

A first conveyance part 21, which conveys the recording sheet 12 guided by the feed guide member 16 onto the platen 50, is provided between the feed guide member 16 and the platen 50. The first conveyance part 21 includes a first conveyance roller 21A of which shaft line extends in the right direction 4 and the left direction 5 and pinch rollers 21B disposed in the right direction 4 and the left direction 5 on the lower side of the first conveyance roller 21A.

When rotation of the unillustrated motor is transmitted to the first conveyance roller 21A, the first conveyance roller 21A rotates in a direction indicated by an arrow D2 in FIG. 2. The pinch rollers 21B are disposed at intervals in the right direction 4 and the left direction 5. Each pinch roller 21B is in contact with the first conveyance roller 21A and rotates while following rotation of the first conveyance roller 21A.

When the recording sheet 12 is conveyed between the first conveyance roller 21A and the pinch rollers 21B in rotating states, the recording sheet 12 is conveyed through the first conveyance route 28A in a substantially horizontal state while being nipped between the first conveyance roller 21A and the pinch rollers 21B. In the following, a direction in which the first conveyance part 21 conveys the recording sheet 12 through the first conveyance route 28A is referred to as a first direction. Further, one side in the first direction (a direction indicated by an arrow 71 in FIG. 2) is referred to as a "first direction 71" and the other side in the first direction (a direction indicated by an arrow 72 in FIG. 2) is referred to as a "second direction 72".

The first conveyance route 28A passes between the platen 50 and the recording unit 31. The recording sheet 12 is conveyed onto the platen 50 by the first conveyance roller 21A and the pinch rollers 21B of the first conveyance part 21.

Figure 3:
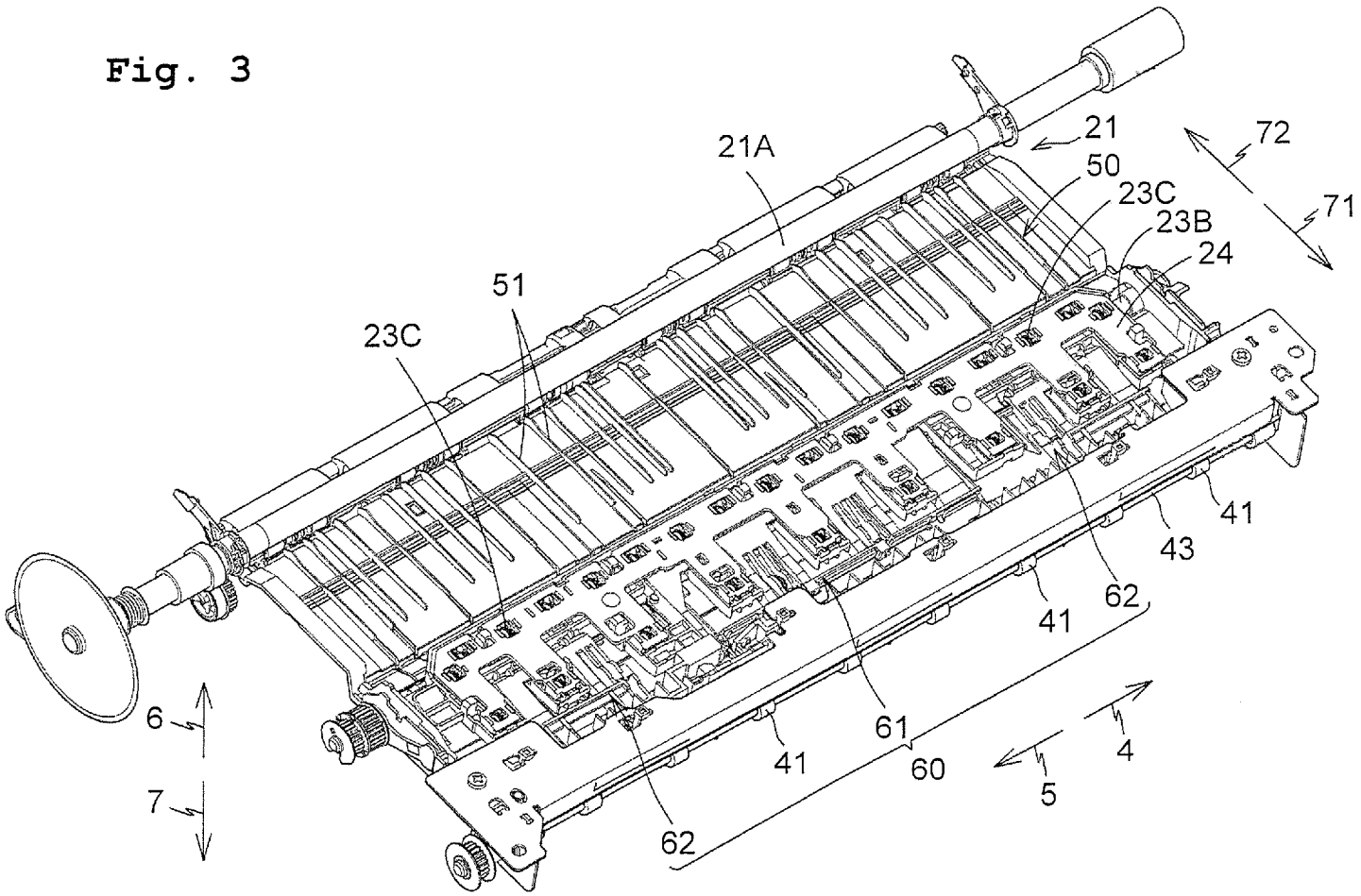
FIG. 3 is a perspective view of a platen 50 and surroundings thereof.

As depicted in FIG. 3, the platen 50 has a flat plate shape. The length of the platen 50 in the right direction 4 and the left direction 5 is longer than the length, in the width direction, of a maximum size of the recording sheet 12 to be conveyed through the first conveyance route 28A. Ribs 51 protruding in the upper direction 6 are provided on the upper surface of the platen 50. The ribs 51, which are disposed at intervals in the right direction 4 and the left direction 5, extend in the first direction 71. The recording sheet 12 conveyed through the first conveyance route 28A is supported on the ribs 51.

As depicted in FIG. 2, the recording unit 31 disposed on the upper side of the platen 50 includes a carriage 32. The carriage 32 is movably supported by an unillustrated guide frame in the right direction 4 and the left direction 5. The guide frame extends in the right direction 4 and the left direction 5.

The carriage 32 may reciprocate on the guide frame in the right direction 4 and the left direction 5. In this embodiment, although a direction in which the carriage 32 reciprocate (the scanning direction) is orthogonal to the first direction 71, the scanning direction is not necessarily orthogonal to the first direction 71. It is only required that the scanning direction intersects with the first direction 71.

A recording head 33 is provided at a lower part of the carriage 32. The recording head 33 includes nozzles 34 from which ink droplets are jetted in the lower direction 7. The ink supplied from an ink cartridge (not depicted) is jetted as ink droplets from each nozzle 34 to the platen 50.

When an image is recorded on the recording sheet 12 conveyed onto the platen 50, the recording sheet 12 is stopped at a position on the platen 50 where the recording sheet 12 faces the recording head 33. Then, the carriage 32 reciprocates in the scanning direction (the right direction 4 and the left direction 5) and ink droplets are selectively jetted from the nozzles 34 during the reciprocating movement. After that, intermittent conveyance of the recording sheet 12 in the first direction 71, reciprocating movement of the carriage 32 when the recording sheet 12 is being stopped, and selective jetting of ink droplets from the nozzles 34 are repeated, thereby recording the image on the recording sheet 12 by use of ink.

A downstream end of the platen 50 in the first direction 71 is positioned downstream of the recording unit 31 in the first direction 71. A second conveyance part 23, which conveys the recording sheet 12 on the platen 50 in the first direction 71, is provided downstream of the downstream end of the platen 50 in the first direction 71.

The second conveyance part 23 includes second conveyance rollers 23A disposed such that shaft lines thereof extend in the right direction 4 and the left direction 5 and first spur rollers 23C disposed on the upper side of the second conveyance rollers 23A. The second conveyance rollers 23A, which are disposed at regular intervals in the right direction 4 and the left direction 5, are attached to a second roller shaft 23B extending in the right direction 4 and the left direction 5. Each of the first spur rollers 23C is in contact with one of the second conveyance rollers 23A disposed on the lower side thereof, and a roller holder 24 depicted in FIG. 3 supports the first spur rollers 23C.

When rotation of the unillustrated motor is transmitted to the second roller shaft 23B, the second roller shaft 23B rotates in a direction indicated by an arrow D3 in FIG. 2. This causes the second conveyance rollers 23A to rotate integrally with the second roller shaft 23B in the same direction. Each of the first spur rollers 23C rotates while following rotation of the corresponding one of the second conveyance rollers 23A. When the recording sheet 12 on the platen 50 is conveyed between the second conveyance rollers 23A and the first spur rollers 23C in rotating states, the recording sheet 12 is conveyed in the first direction 71 while being nipped by the second conveyance rollers 23A and the first spur rollers 23C.

A support guide 80, which is provided downstream of the second conveyance part 23 in the first direction 71, supports the recording sheet 12 conveyed through the first conveyance route 28A from below. The support guide 80 extends across the first conveyance route 28A in the right direction 4 and the left direction 5, and an upper surface 82 of the support guide 80 is horizontal. Details of the support guide 80 will be described later.

The first conveyance route 28A is connected to the second conveyance route 28B at the downstream of the support guide 80 in the first direction 71. A switchback conveyance part 40 is provided downstream of the connection part between the first conveyance route 28A and the second conveyance route 28B in the first direction 71. The sheet guide part 60 is provided on the upper side of the first conveyance route 28A to face the connection part between the first conveyance route 28A and the second conveyance route 28B.

The recording sheet 12 conveyed from the second conveyance part 23 in the first direction 71 is conveyed to the switchback conveyance part 40 while being guided by the sheet guide part 60. The switchback conveyance part 40 may selectively convey the recording sheet 12 in the first direction 71 or the second direction 72 that is an opposite direction of the first direction 71.

The second conveyance route 28B, which extends from the first conveyance route 28A in the rear direction 9 while being inclined in the lower direction 7, is connected to the first conveyance route 28A at an upstream position of the recording unit 31 in the first direction 71. The second conveyance route 28B is defined by a conveyance guide 25 and a frame 27. The conveyance guide 25 extends rearward from the upstream of the switchback conveyance part 40 in the first direction 71 while being inclined in the lower direction 7. The frame 27, which faces the conveyance guide 25, supports a guide surface 81 of the support guide 80, the first conveyance part 21, and the like.

The switchback conveyance part 40 includes switchback rollers 41 disposed such that shaft lines thereof extend in the right direction 4 and the left direction 5 and second spur rollers 42 disposed on the upper side of the switchback rollers 41. As depicted in FIG. 3, the switchback rollers 41, which are disposed at regular intervals in the right direction 4 and the left direction 5, are attached to a third roller shaft 43 extending in the right direction 4 and the left direction 5. Each of the second spur rollers 42 is in contact with the corresponding one of the switchback rollers 41 disposed on the lower side thereof.

The third roller shaft 43 may rotate in both directions indicated by arrows D4, D5 (see FIG. 2) by the unillustrated motor. Each of the second spur rollers 42 rotates while following rotation of the corresponding one of the switchback rollers 41. In the following, rotation in the direction indicated by the arrow D4 is referred to as "normal rotation" and rotation in the direction indicated by the arrow D5 is referred to as "reverse rotation". Normal rotation of the switchback rollers 41 conveys the recording sheet 12 in the first direction 71, and reverse rotation of the switchback rollers 41 conveys the recording sheet 12 in the second direction 72.

The third roller shaft 43 rotates normally in synchronization with the second conveyance rollers 23A of the second conveyance part 23. This causes the switchback rollers 41 to rotate normally in synchronization with the third roller shaft 43. When the recording sheet 12 gets in between the switchback rollers 41 and the second spur rollers 42 rotating normally, the recording sheet 12 is conveyed in the first direction 71 while being nipped between the switchback rollers 41 and the second spur rollers 42. Reverse rotation of the switchback rollers 41 when the recording sheet 12 is being nipped between the switchback rollers 41 and the second spur rollers 42 conveys the recording sheet 12 in the second direction 72.

A discharge tray 17 is provided downstream of the switchback conveyance part 40 in the first direction 71. The discharge tray 17 extends frontward in a substantially horizontal state on the lower side of the contact positions between the switchback rollers 41 and the second spur rollers 42 of the switchback conveyance part 40. The recording sheets 12 may be stacked on the discharge tray 17.

When single-side printing, in which the recording sheet 12 having an image recorded on one surface (one surface is assumed to be a "first surface") is discharged on the discharge tray 17, is performed, normal rotation of the third roller shaft 43 is continued while the recording sheet 12 passes between the switchback rollers 41 and the second spur rollers 42. Accordingly, the recording sheet 12 having the image recorded on the first surface is discharged on the discharge tray 17.

When both-side printing, in which images are recorded not only on the first surface but also on the opposite surface of the first surface (the opposite surface is assumed to be a "second surface") of the recording sheet 12, is performed, the switchback conveyance part 40 and the sheet guide part 60 convey the recording sheet 12 having the image recorded on the first surface to the second conveyance route 28B. The operation of the switchback conveyance part 40 and the sheet guide part 60 for the both-side printing will be described later.

<Sheet Guide Part 60 and Support Guide 80>

Figure 4:
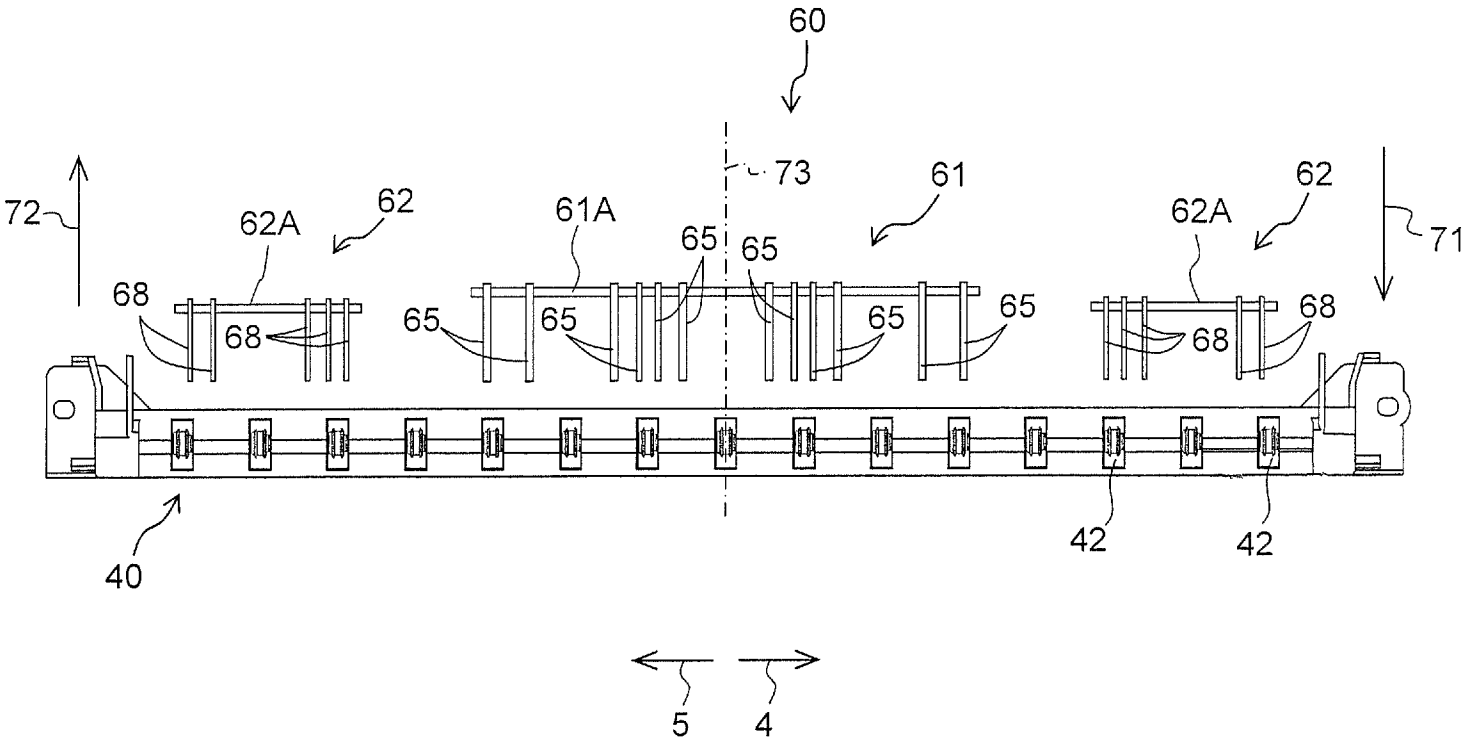
FIG. 4 is a schematic plan view of a sheet guide part 60 and a switchback conveyance part 40.
Figure 5:
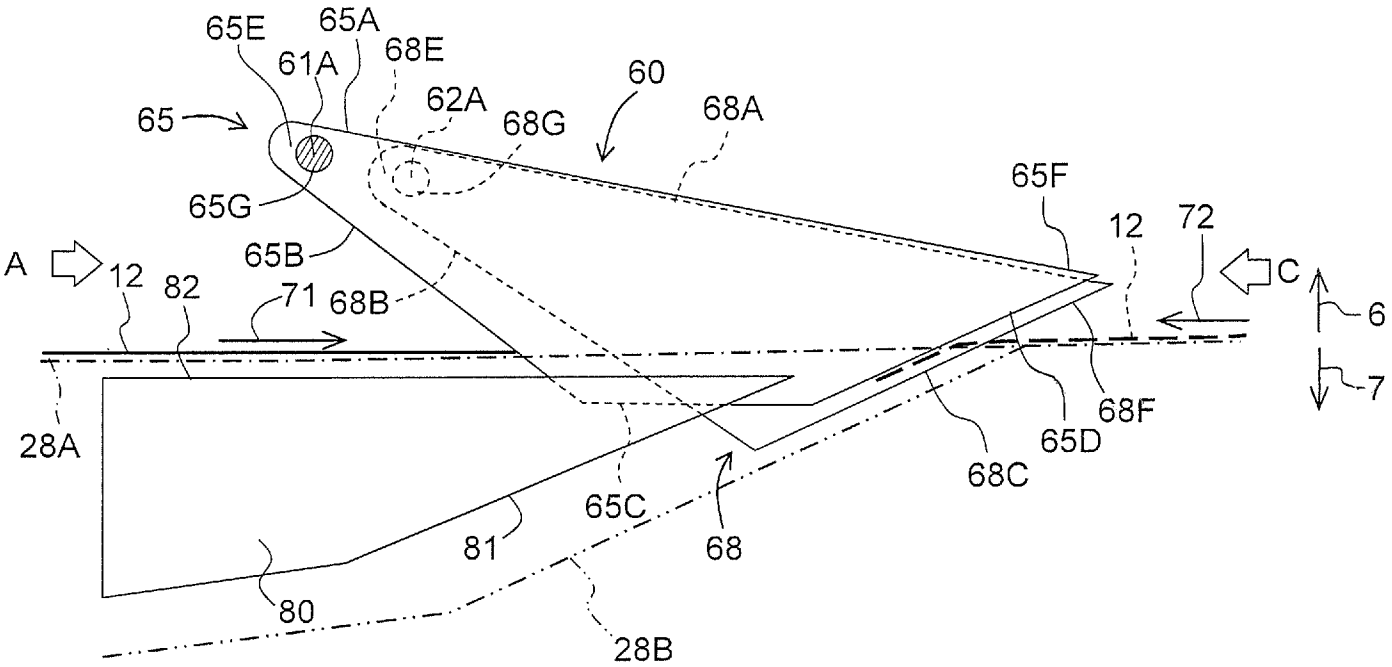
FIG. 5 is a schematic side view illustrating configurations of a first flap 65 and a second flap 68 in the sheet guide part 60.

As depicted in FIGS. 4 and 5, the sheet guide part 60 includes a first guide member 61 and second guide members 62. The first guide member 61 is disposed at the center of the first conveyance route 28A in the right direction 4 and the left direction 5. The second guide members 62 are disposed at ends of the first conveyance route 28A in the right direction 4 and the left direction 5, respectively. As depicted in FIG. 2, the first guide member 61 and the second guide member 62, which are positioned on the upper side of the connection part between the first conveyance route 28A and the second conveyance route 28B, extend from the rear side of the connection part to the connection part in the first direction 71.

As depicted in FIG. 4, the first guide member 61 includes first flaps 65 formed in a flat plate shape. The first flap 65 has side surfaces each of which is a flat plate-shaped maximum surface and extends in the upper direction 6, the lower direction 7, the front direction 8, and the rear direction 9. All of the first flaps 65 have the same shape. The first flaps 65 are fixed to a first support shaft 61A in such a manner that they are disposed at intervals in the right direction 4 and the left direction 5. Profiles of the first flaps 65 fixed to the first support shaft 61A overlap with each other as viewed in the right direction 4 or the left direction 5.

Each of the second guide members 62 includes second flaps 68 formed in a flat plate shape. The second flap 68 has side surfaces each of which is a flat plate-shaped maximum surface and extends in the upper direction 6, the lower direction 7, the front direction 8, and the rear direction 9. All of the second flaps 68 have substantially the same shape, but they are different in shape from the first flaps 65. The second flaps 68 are fixed to a second support shaft 62A in such a manner that they are disposed at intervals in the right direction 4 and the left direction 5. Profiles of the second flaps 68 fixed to the second support shaft 62A overlap with each other as viewed in the right direction 4 or the left direction 5.

Figure 8A:
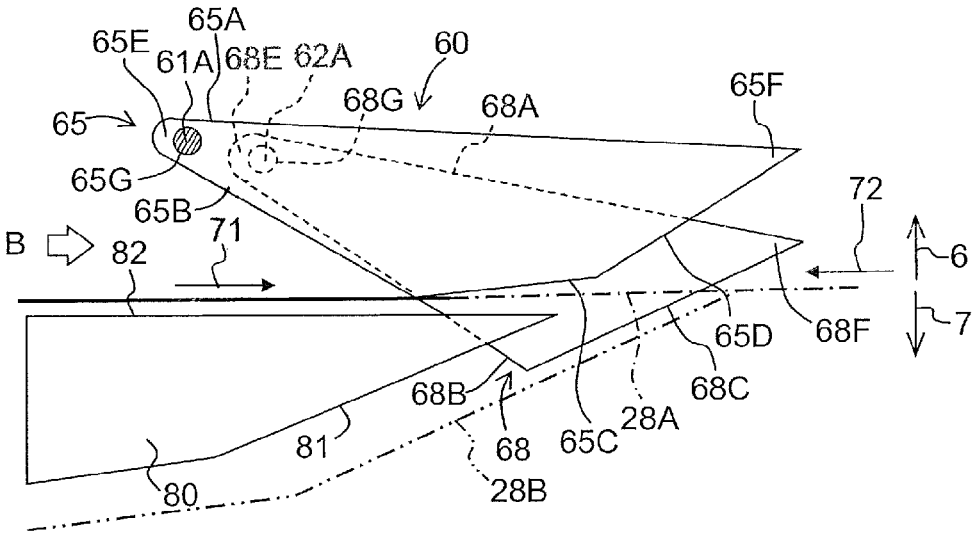
FIGS. 8A and 8B are schematic diagrams each illustrating operation or movement of the first flam 65 and the second flam 68 in the sheet guide part 60.

Each of the first flaps 65 may move between a state in which the first flap 65 guides the center in the width direction of the recording sheet 12 conveyed in the first direction 71 to the switchback conveyance part 40 and a state in which the first flap 65 guides the center in the width direction of the recording sheet 12 conveyed through the first conveyance route 28 in the second direction 72 to the second conveyance route 28B. The state of the first flap 65, as depicted in FIG. 8A, in which the first flap 65 guides the center in the width direction of the recording sheet 12 conveyed in the first direction 71 to the switchback conveyance part 40 is referred to as a "first state". The state of the first flap 65, as depicted in FIG. 5, in which the first flap 65 guides the center in the width direction of the recording sheet 12 conveyed through the first conveyance route 28A in the second direction 72 to the second conveyance route 28B is referred to as a "second state".

Figure 8B:
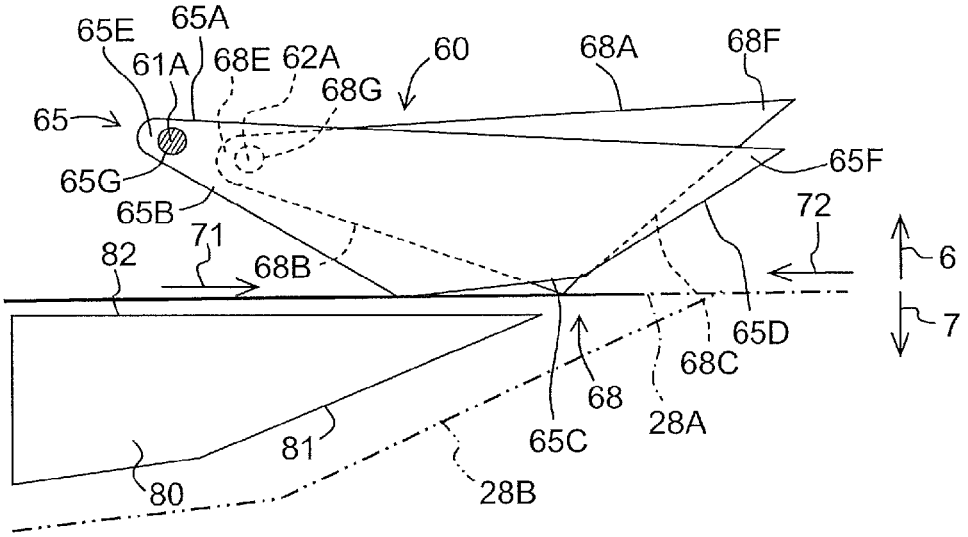

Each of the second flaps 68 may move between a state in which the second flap 68 guides the both ends in the width direction of the recording sheet 12 conveyed in the first direction 71 to the switchback conveyance part 40 and a state in which the second flap 68 guides the both ends in the width direction of the recording sheet 12 conveyed through the first conveyance route 28A in the second direction 72 to the second conveyance route 28B. The state of the second flap 68, as depicted in FIG. 8B, in which the second flap 68 guides the both ends in the width direction of the recording sheet 12 conveyed in the first direction 71 to the switchback conveyance part 40 is referred to as a "third state". The state of the second flap 68, as depicted in FIG. 5, in which the second flap 68 guides the both ends in the width direction of the recording sheet 12 conveyed through the first conveyance route 28A in the second direction 72 to the second conveyance route 28B is referred to as a "fourth state".

In FIG. 5, the first flap 65 is in the second state and the second flap 68 is in the fourth state. Although FIG. 5 depicts a space between the recording sheet 12 and the upper surface 82 of the support guide 80, in fact, the recording sheet 12 slides on the upper surface 82 of the support guide 80 actually. As depicted in FIG. 5, an upstream end 65E (to be referred to as a "first upstream end 65E") of the first flap 65 in the first direction 71 has a shape tapering toward the upstream in the first direction 71. The first upstream end 65E is formed of an upstream end of an upper surface 65A of the first flap 65 and an upstream end of a contact surface 65B (an exemplary "first contact portion") positioned on the lower side of the upper surface 65A. In the following, the upper surface 65A of the first flap 65 is referred to as a "first upper surface 65A" and the contact surface 65B of the first flap 65 is referred to as a "first contact surface 65B".

As depicted in FIG. 2, the first upstream end 65E is positioned upstream, in the first direction 71, of a downstream end of the support guide 80 in the first direction 71. The support guide 80 includes slits (note depicted) extending frontward on the lower side of the first flaps 65 and the second flaps 68. Lower ends of the first flaps 65 in the second state and lower ends of the second flaps 68 in the fourth state may enter the respective slits. The first flaps 65 in the second state and the second flaps 68 in the fourth state make contact with parts of the support guide 80 positioned on the rear side of the respective slits so that the first flaps 65 may keep the second state and the second flaps 68 may keep the fourth state.

A guide surface 81, which faces the lower direction 7, is provided at a downstream end of the support guide 80 in the first direction 71. The guide surface 81 extends downward and rearward from its end in the first direction 71 while being inclined to the level.

A downstream end 65F (to be referred to as a "first downward end 65F") of the first flap 65 in the first direction 71 has a shape tapering toward the downstream in the first direction 71. The first downstream end 65F is formed of a downstream end of the first upper surface 65A and a contact surface 65D (an exemplary "fourth contact portion") provided on the lower side of the first upper surface 65A. In the following, the contact surface 65D is to be referred to as a "fourth contact surface 65D".

The first upper surface 65A is a flat surface extending in the first direction 71. The upstream end of the first upper surface 65A in the first direction 71 is connected to the upstream end of the first contact surface 65B in the first direction 71 via a curved surface curved in an arc shape that is convex upstream in the first direction 71. The first contact surface 65B is inclined to the level to be increasingly distanced from the first upper surface 65A toward the downstream in the first direction 71.

As depicted in FIG. 5, the first upstream ends 65E of all of the first flaps 65 include through holes 65G. The first support shaft 61A (an exemplary "first shaft") depicted in FIG. 4 is inserted through the through holes 65G. All of the first flaps 65 are integrally attached to the first support shaft 61A so that they may rotate integrally with the first support shaft 61A. The first support shaft 61A extends in the right direction 4 and the left direction 5. The roller holder 24 (see FIG. 3) supporting the first spur rollers 23C rotatably supports the both ends of the first support shaft 61A in the right direction 4 and the left direction 5.

When each first flap 65 is in the second state, the first contact surface 65B is inclined to be increasingly distanced from the first conveyance route 28A toward the upstream in the first direction 71.

The recording sheet 12 conveyed from the second conveyance part 23 in the first direction 71 is supported horizontally on the support guide 80. The center in the width direction of the recording sheet 12 conveyed through the first conveyance route 28A in the first direction 71 makes contact with the first contact surfaces 65B of the first flaps 65 in the second state. When conveyance of the recording sheet 12 in contact with the first contact surfaces 65B is continued, the recording sheet 12 supported on the support guide 80 lifts or holds up the first flaps 65 in such a manner that the first downstream ends 65F rotate upward. As a result, all of the first flaps 65 rotate (move) to reach the first state depicted in FIG. 8B.

An intermediate surface 65C, which is connected to a downstream end of the first contact surface 65B in the first direction 71, extends downstream in the first direction 71. The intermediate surface 65C is a flat surface extending in the first direction 71. When the first flap 65 is in the second state, the intermediate surface 65C extends along the first direction 71. In this situation, a downstream end of the intermediate surface 65C in the first direction 71 is positioned downstream of the support guide 80 in the first direction 71.

The fourth contact surface 65D is connected to a downstream end of the intermediate surface 65C in the first direction 71. When the first flap 65 is in the second state, the fourth contact surface 65D is inclined to be increasingly distanced from the second conveyance route 28B toward the upstream in the second direction 72. The downstream end of the fourth contact surface 65D in the first direction 71 is connected to the downstream end of the first upper surface 65A in the first direction 71. The fourth contact surfaces 65D of the first flaps 65 in the second state guide the center in the width direction of the recording sheet 12 conveyed in the second direction 72 by the switchback conveyance part 40.

As depicted in FIG. 5, similar to the first flap 65, the second flap 68 of the second guide member 62 has a shape in which an upstream end 68E (to be referred to as a "second upstream end 68E") in the first direction 71 tapers toward the upstream in the first direction 71. The second upstream end 68E of the second flap 68 is disposed downstream of the first upstream end 65E of the first flap 65 in the first direction 71 with a space between the second upstream end 68E and the support guide 80 in the upward direction 6.

As depicted in FIG. 5, the second upstream end 68E of the second flap 68 is formed of an upper surface 68A of the second flap 68 and a contact surface 68B disposed on the lower side of the upper surface 68A. In the following, the upper surface 68A of the second flap 68 is referred to as a "second upper surface 68A" and the contact surface 68B of the second flap 68 (an exemplary "second contact portion") is referred to as a "second contact surface 68B".

A downstream end 68F (to be referred to as a "second downstream end 68F") of the second flap 68 in the first direction 71 has a shape tapering toward the downstream in the first direction 71. The second downstream end 68F is formed of a downstream end of the second upper surface 68A and a downstream end of a contact surface 68C (an exemplary "third contact portion") provided on the lower side of the second upper surface 68A. In the following, the contact surface 68C is referred to as a "third contact surface 68C". An upstream end of the third contact surface 68C in the first direction 71 is connected to the downstream end of the second contact surface 68B in the first direction 71.

The second upper surface 68A is a flat surface extending in the first direction 71. The upstream end of the second upper surface 68A in the first direction 71 is connected to the upstream end of the second contact surface 68B in the first direction 71 via a curved surface curved in an arc shape that is convex upstream in the first direction 71. The second contact surface 68B is inclined to be increasingly distanced from the second upper surface 68A toward the downstream in the first direction 71.

As depicted in FIG. 5, the second upstream end 68E is positioned upstream, in the first direction 71, of the downstream end of the support guide 80 in the first direction 71 and downstream, in the first direction 71, of the first upstream end 65E of the first flap 65. The second upstream ends 68E of all of the second flaps 68 include through holes 68G. The second support shaft 62A (an exemplary "second shaft") depicted in FIG. 4 is inserted through the through holes 68G. All of the second flaps 68 are integrally attached to the second support shaft 62A so that they may rotate integrally with the second support shaft 62A. The second support shaft 62A extends in the right direction 4 and the left direction 5. The roller holder 24 (see FIG. 3) supporting the first spur rollers 23C rotatably supports the both ends of the second support shaft 62A in the right direction 4 and the left direction 5.

As depicted in FIG. 5, when all of the second flaps 68 have no contact with the recording sheet 12, the downstream ends of the second contact surfaces 68B of the second flaps 68 enter, under their own weight, the slits provided in the downstream end of the support guide 80 in the first direction 71, that is, the second flaps 68 are in contact with the support guide 80. In this situation, the second flaps 68 are in the fourth state.

The first contact surface 65B of the first flap 65 in the second state is positioned upstream in the first direction 71 of the second contact surface 68B of the second flap 68 in the fourth state, and in this situation, the first contact surface 65B is parallel to the second contact surface 68B. Thus, conveying the recording sheet 12 on the support guide 80 in the first direction 71 brings a downstream end of the recoding sheet 12 in the first direction 71 contact with the first contact surfaces 65B and then with the second contact surfaces 68B.

The recording sheet 12 conveyed from the second conveyance part 23 in the first direction 71 is supported horizontally on the support guide 80. Conveying the recording sheet 12 through the first conveyance route 28A in the first direction 71 brings both ends of the upper surface of the recording sheet 12 in the width direction contact with the second contact surfaces 68B of the second flaps 68 in the fourth state. When conveyance of the recording sheet 12 in contact with the second contact surfaces 68B is continued, the recording sheet 12 supported on the support guide 80 lifts or holds up the second flaps 68 in such a manner that the second downstream ends 68F rotate upward. As a result, all of the second flaps 68 rotate (move) to reach the third state depicted in FIG. 8B.

As depicted in FIG. 5, when the second flap 68 is in the fourth state, the third contact surface 68C, which is connected to the downstream end of the second contact surface 68B in the first direction 71, is inclined similarly to the fourth contact surface 65D of the first flap 65 in the second state. Namely, when the second flap 68 is in the fourth state, the third contact surface 68C is inclined to be increasingly distanced from the second conveyance route 28B toward the upstream in the second direction 72. The third contact surface 68C of the second flap 68 in the fourth state is positioned on the lower side of the fourth contact surface 65D of the first flap 65 in the second state, and in this situation, the third contact surface 68C is parallel to the fourth contact surface 65D. Thus, the downstream end in the second direction 72 of the recording sheet 12 conveyed in the second direction 72 by the switchback conveyance part 40 is guided such that both ends in the width direction of the recording sheet 12 in contact with the third contact surfaces 68C are positioned on the lower side of the center in the width direction of the recording sheet 12 in contact with the fourth contact surfaces 65D.

<Both-Side Printing>

Subsequently, an explanation will be made about both-side printing performed in the multifunctional peripheral 10 of this embodiment. The following explanation will be given in assuming that the recording sheet 12 makes contact with all of the second flaps 68.

When the multifunctional peripheral 10 performs both-side printing, the recording unit 31 records an image on the first surface, which faces the upper direction 6, of the recording sheet 12 in a state where the recording sheet 12 is supported on the platen 50, similar to the single-side printing. When an image is recorded on the recording sheet 12, blanks, in which no image is to be formed, are typically provided at both ends of the recording sheet 12 in the width direction. Thus, the ink amount adhering to the center in the width direction tends to be larger than those adhering to both ends in the width direction. The recording sheet 12 having the ink adhering thereto swells by moisture of the ink. A deformation amount caused by swell is larger, as the ink amount adhering to the recording sheet 12 is larger.

Figure 6:
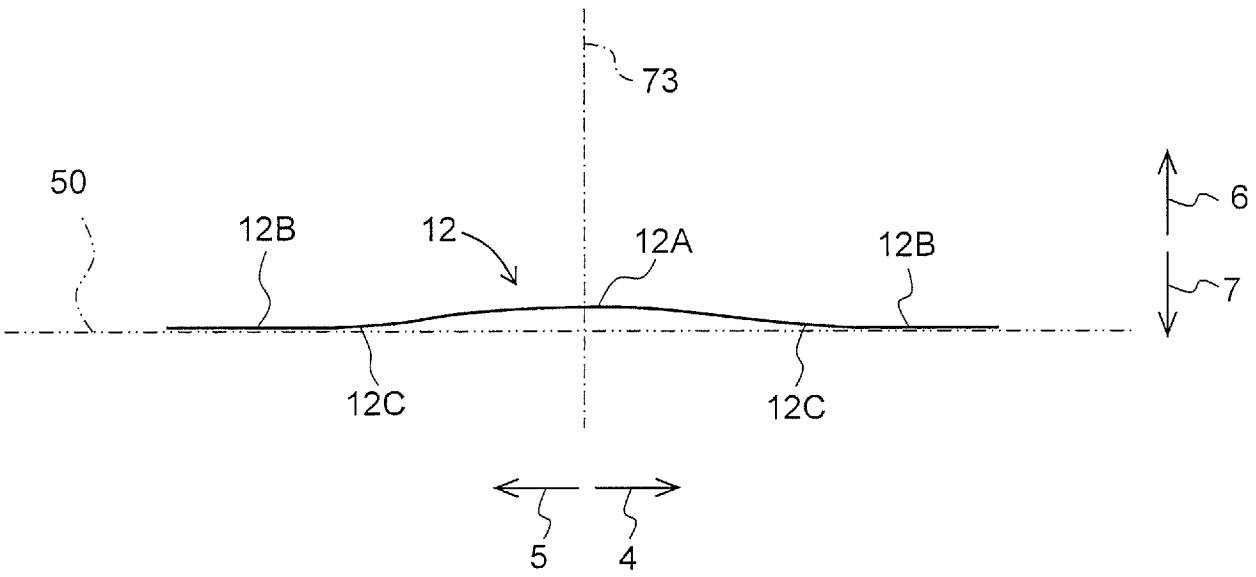
FIG. 6 is a schematic diagram illustrating a state of a recording sheet 12, for which an image has been recorded, on the platen 50.

As depicted in FIG. 6, the recording sheet 12 disposed on the platen 50 and having the image recorded thereon curves such that a center 12A in the width direction (hereinafter, also referred to simply as the center 12A) is convex in the upper direction 6. This forms curves 12C, of which curves are gentle and convex in an opposite direction of the center 12A, on outer sides of the upward convex part in the right direction 4 and the left direction 5.

The recording sheet 12 disposed on the platen 50 and having the image recorded thereon is conveyed in the first direction 71 by the second conveyance part 23, and then reaches a position below the sheet guide part 60. In this situation, all of the first flaps 65 of the first guide member 61 of the sheet guide part 60 are in the second state, and all of the second flaps 68 of the second guide member 62 of the sheet guide part 60 are in the fourth state.

When the recording sheet 12 reaches the position below the sheet guide part 60, the center 12A of the first surface (corresponding to a "recording surface") having the image recorded thereon makes contact with the first contact surfaces 65B of the first flaps 65 in the second state. At that time, both ends 12B of the recording sheet 12 in the width direction (hereinafter, also referred to simply as the both ends 12B) have no contact with the second flaps 68 of the second guide members 62 disposed at both ends of the first conveyance route 28A in the right direction 4 and the left direction 5.

The recording sheet 12 in contact with the first contact surfaces 65B of the first flaps 65 is conveyed in the first direction 71 in such a manner that the center 12A of the first surface is in slide contact with the first contact surfaces 65B. In this situation, the center 12A of the recording sheet 12 that is convex upward is pressed downward by the first contact surfaces 65B of the first flaps 65, thus reducing the upward convex amount of the center 12A of the recording sheet 12 supported on the support guide 80.

Figure 7A:
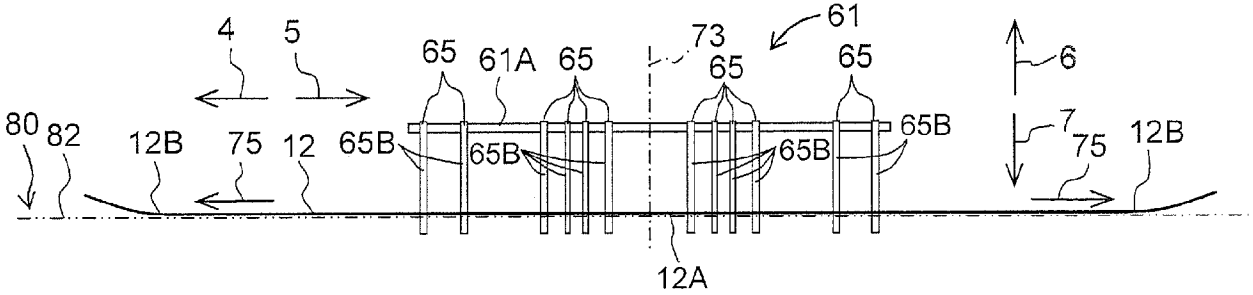
FIGS. 7A to 7C are schematic diagrams each illustrating a state change in the recording sheet 12 passing the sheet guide part 60.

The center 12A of the recording sheet 12 is pressed downward to make contact with the upper surface 82 of the support guide 80, as depicted in FIG. 7A. In FIG. 5, the recording sheet 12, of which center 12A is in contact with the upper surface 82 of the support guide 80, is depicted by a solid line. FIG. 7A depicts the recording sheet 12 and the first guide member 61 as viewed in a direction indicated by an arrow A of FIG. 5.

The force by which the center 12A of the recording sheet 12 is pressed downward eliminates the curves 12C formed at outer sides of the center 12A in the right direction 4 and the left direction 5. This force is force 75 that acts on the both ends 12B toward outer sides thereof in the right direction 4 and the left direction 5. Since the force 75 includes reaction force from the support guide 80, the force 75 causes outer side edges of the both ends 12B to float upward.

Eliminating the convex part of the center 12A of the recording sheet 12 allows the center 12A to be supported on the support guide 80. When the recording sheet 12 of which center 12A is supported on the support guide 80 is conveyed in the first direction 71, the center 12A supported on the support guide 80 lifts the first contact surfaces 65B of the first flaps 65 upward. As a result, as depicted in FIG. 8A, downstream ends of all of the first flaps 65 in the first direction 71 rotate upward.

Figure 7B:
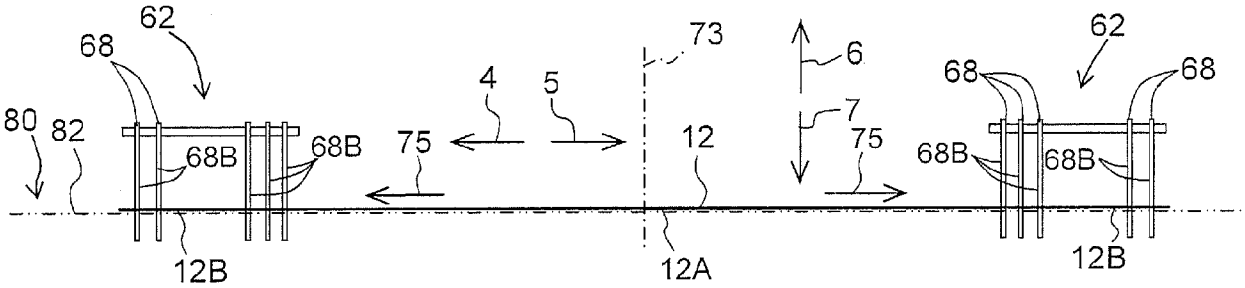

When the recording sheet 12 that causes the downstream ends of the first flaps 65 to be lifted higher than the second state in the upper direction 6 is conveyed in the first direction 71, the both ends 12B of the recording sheet 12 make contact with the second contact surfaces 68B of the second flaps 68, as depicted in FIG. 8A. FIG. 7B depicts the recording sheet 12 and the second guide members 62 as viewed in a direction indicated by an arrow B of FIG. 8A. As depicted in FIG. 7B, the both ends 12B of the recording sheet 12 are pressed downward by the second contact surfaces 68B of the second flaps 68. Thus, the both ends 12B of the recording sheet 12 are flat along the upper surface 82 of the support guide 80.

All of the first flaps 65 are maintained in the first state by bringing the contact portions between the first contact surfaces 65B and the intermediate surfaces 65C into slide contact with the center 12A of the recording sheet 12. The recording sheet 12 is conveyed to the switchback conveyance part 40 in such a manner that the center 12A is guided by the first flaps 65 in the first state. Here, the force acting on the first flaps 65 from the center 12A of the recording sheet 12 having no convex part is smaller than the force acting on the first flaps 65 from the center 12A of the recording sheet 12 having the convex part. Thus, the present teaching is less likely to have a large load which would be otherwise applied on the recording sheet 12 that moves while making contact with the first flaps 65, thus stabilizing conveyance of the recording sheet 12.

The both ends 12B of the recording sheet 12 extend along the upper surface 82 of the support guide 80 by being pressed with the second contact surfaces 68B of the second flaps 68, and in this situation, the recording sheet 12 causes the second contact surfaces 68B of the second flaps 68 to be lifted higher than the fourth state in the upper direction 6. As a result, all of the second flaps 68 reach the third state, as depicted in FIG. 8B. All of the second flaps 68 are maintained in the third state by bringing the connection parts between the second contact surfaces 68B and the third contact surfaces 68C into slide contact with the both ends 12B of the recording sheet 12, thus allowing the both ends 12B of the recording sheet 12 to be conveyed to the switchback conveyance part 40.

In the switchback conveyance part 40, the switchback rollers 41 rotate normally in synchronization with the second conveyance rollers 23A of the second conveyance part 23, thus allowing the recording sheet 12 conveyed in the first conveyance direction 71 to get in between the switchback rollers 41 and the second spur rollers 42. In this situation, the center 12A of the recording sheet 12 is not convex in the upper direction 6 and the both ends 12 of the recording sheet 12 do not float in the upper direction 6, thus allowing the recording sheet 12 to get in between the switchback rollers 41 and the second spur rollers 42 smoothly. The recording sheet 12 getting in between the switchback rollers 41 and the second spur rollers 42 is conveyed in the first direction 71.

After an upstream end of the center 12A of the recording sheet 12 in the first direction 71 passes through the connection parts between the first contact surfaces 65B and the intermediate surfaces 65C of the first flaps 65 in the first direction 71, the first flaps 65 in the first state rotate to reach the second state. The rotation of the first flaps 65 brings the upstream end of the center 12A of the recording sheet 12 in the first direction 71 into slide contact with the intermediate surfaces 65C of the first flaps 65. The upstream end of the center 12A of the recording sheet 12 in the first direction 71 passes, in the first direction 71, through the downstream end of the support guide 80 in the first direction 71 while being brought into slide contact with the intermediate surfaces 65C. Thus, the support guide 80 is no longer able to support the upstream end of the center 12A of the recording sheet 12 in the first direction 71. This causes the first flaps 65 to rotate under their own weight so as to reach the second state, and the upstream end of the center 12A of the recording sheet 12 in the first direction 71 is pressed downward with the first flaps 65 in the rotating state. Accordingly, the first flaps 65 have the second state, and the upstream end of the center 12A of the recording sheet 12 in the first direction 71 makes contact with the fourth contact surfaces 65D of the first flaps 65 in the second state.

Upstream ends of the both ends 12B of the recording sheet 12 in the first direction 71 pass, in the first direction 71, through the downstream end of the support guide 80 in the first direction 71 while being brought into slide contact with the connection parts between the second contact surfaces 68B and the third contact surfaces 68C of the second flaps 68. Thus, the support guide 80 is no longer able to support the upstream ends of the both ends 12B of the recording sheet 12 in the first direction 71. This causes the second flaps 68 to rotate under their own weight so as to reach the fourth state, and the upstream ends of the both ends 12B of the recording sheet 12 in the first direction 71 are pressed downward with the second flaps 68 in the rotating state. Accordingly, the second flaps 68 have the fourth state, and the upstream ends of the both ends 12B of the recording sheet 12 in the first direction 71 make contact with the third contact surfaces 68C of the second flaps 68 in the fourth state.

Figure 7C:
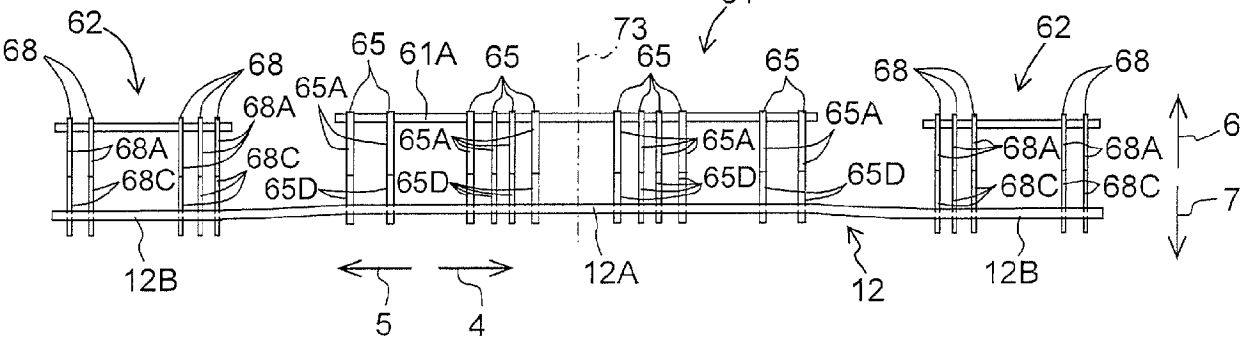

The switchback roller 41 is controlled so that its rotation direction is switched from normal rotation to reverse rotation in a state where the upstream end of the recording sheet 12 in the first direction 71 is in contact with the fourth contact surfaces 65D of the first flaps 65 in the second state and the third contact surfaces 68C of the second flaps 68 in the fourth state. In FIG. 5, the recording sheet 12, of which upstream end in the first direction 71 is in contact with the fourth contact surface 65D of the first flap 65 in the second state and the third contact surface 68C of the second flap 68 in the fourth state, is depicted by a broken line. FIG. 7C depicts the recording sheet 12, the first guide member 61, and the second guide members 62 as viewed in a direction indicated by an arrow C of FIG. 5.

As depicted in FIG. 7C, the third contact surfaces 68C of the second flaps 68 are positioned on the lower side of the fourth contact surfaces 65D of the first flaps 65. Thus, the recording sheet 12 is guided to the second conveyance route 28B in such a manner that the both ends 12B are pressed further downward than the center 12A. This prevents the both ends 12B from floating upward which would be otherwise caused by, for example, elasticity of the recording sheet 12. Thus, the both ends 12B of the recording sheet 12 are prevented from being caught by the second flaps 68 and the support member 80, and the recording sheet 12 conveyed in the second direction 72 is guided to the second conveyance route 28B stably.

The third contact surfaces 68C of the second flaps 68 extend, toward the second conveyance route 28B, beyond the fourth contact surfaces 65D of the first flaps 65. Thus, the distance over which the third contact surfaces 68C guide the both ends 12B of the recording sheet 12 conveyed in the second direction 72 to the second conveyance route 28B is longer than the distance over which the fourth contact surfaces 65D guide the center 12A of the recording sheet 12 to the second conveyance route 28B. Accordingly, the recording sheet 12 is guided to the second conveyance route 28B while the both ends 12B are reliably prevented from floating upward.

For example, each switchback roller 41 is switched from normal rotation to reverse rotation depending on output of a sensor and rotation amounts of the second conveyance roller 23A and the switchback roller 41 rotating in synchronization with each other, wherein the sensor is provided upstream of the switchback conveyance part 40 in the first direction 71 and outputs different signals based on whether the conveyance sheet 12 conveyed in the first direction 71 is present. For example, a position of the upstream end of the recording sheet 12 in the first direction 71 is detected based on the output of the sensor, and the position of the upstream end of the recording sheet 12 in the first direction 71 is determined based on rotation amounts of the second conveyance roller 23A and the switchback roller 41 after detection with the sensor. Then, rotation of each switchback roller 41 is switched at the timing at which the upstream end of the recording sheet 12 in the first direction 71 reaches a preset position, such as the connection part between the first conveyance route 28A and the second conveyance route 28B.

The recording sheet 12 guided to the second conveyance route 28B by the first flaps 65 and the second flaps 68 passes through the second conveyance route 28B, and enters the first conveyance route 28A again at a part, of the first conveyance route 28A, upstream of the recording unit 31 in the first direction 71. The recording sheet 12 entering the first conveyance route 28A is conveyed on the platen 50 by being guided with the feed guide member 16 in a state where the first surface and the second surface are reversed.

The recording unit 31 records an image on the second surface, which faces upward, of the recording sheet 12 conveyed on the platen 50. Then, similar to the case in which the recording unit 31 records the image on the first surface, the recording sheet 12 is conveyed to the switchback conveyance part 40 by being guided with the first flaps 65 of the first guide member 61 and the second flaps 68 of the second guide member 62 of the sheet guide part 60. The normal rotation of the switchback rollers 41 of the switchback conveyance part 40 continues until the recording sheet 12 getting in between the switchback rollers 41 and the second spur rollers 42 is discharged on the discharge tray 17. Accordingly, the recording sheet 12 having images recorded on both surfaces is discharged on the discharge tray 17.

<Function and Effect of Embodiment>

In this embodiment, the recording sheet 12 having the image recorded on the first surface is guided in the first direction 71 in such a manner that the center 12A is firstly guided with the first contact surfaces 65B of the first flaps 65 in the first direction 71 and then the both ends 12B are guided with the second contact surfaces 68B of the second flaps 68 in the first direction 71. The first contact surfaces 65B of the first flaps 65 reduce the upper convex amount of the center 12A of the recording sheet 12. Thus, the pressing force acting on the center 12A of the recording sheet 12 from the first contact surfaces 65B of the first flaps 65 is reduced, which allows the recording sheet 12 to be conveyed in the first direction 71 stably.

The recording sheet 12 conveyed in the second direction 72 by the switchback conveyance part 40 is guided to the second conveyance route 28B by the fourth contact surfaces 65D of the first flaps 65 and the third contact surfaces 68C of the second flaps 68. Since the third contact surfaces 68C of the second flaps 68 are positioned on the lower side of the fourth contact surfaces 65D of the first flaps 65, the recording sheet 12 is conveyed to the second conveyance route 28B in such a manner that the both ends 12B are pressed further downward than the center 12A. Thus, the both ends 12B of the recording sheet 12 are prevented from being caught by the second flaps 68 and the support member 80, and the recording sheet 12 conveyed in the second direction 72 is guided to the second conveyance route 28B stably.

The distance over which the both ends 12B of the recording sheet 12 are guided through the second conveyance route 28B toward the downstream in the conveyance direction by the third contact surfaces 68C of the second flaps 68 is longer than the distance over which the center 12A of the recording sheet 12 is guided through the second conveyance route 28B toward the downstream in the conveyance direction by the fourth contact surfaces 65D of the first flaps 65. Thus, even when the both ends 12B of the recording sheet 12 have curves or even when force curving the both ends 12B is applied thereon, the recording sheet 12 is guided to the second conveyance route 28B stably.

The first upper ends 65E of the first flaps 65 are rotatably supported by the first support shaft 61A, and the second upstream ends 68E of the second flaps 68 are rotatably supported by the second support shaft 62A. The first support shaft 61A is positioned upstream of the second support shaft 62A in the first direction 71. Thus, the moment when the first flaps 65 in the second state rotate to reach the first state is allowed to be smaller than the moment when the second flaps 68 in the fourth state rotate to reach the third state.

The first contact surfaces 65B of the first flaps 65 are inclined surfaces which are inclined to be increasingly distanced from the first conveyance route 28A toward the upstream in the first direction 71. The second contact surfaces 68B of the second flaps 68 are inclined surfaces which are inclined to be increasingly distanced from the first conveyance route 28A toward the upstream in the first direction 71. Thus, the recording sheet 12 conveyed in the first direction 71 causes the first flaps 65 in the second state to reach the first state smoothly. Further, the recording sheet 12 conveyed in the first direction 71 causes the second flaps 68 in the fourth state to reach the third state smoothly. Accordingly, the recording sheet 12 is stably guided in the first direction 71 by the first flaps 65 and the second flaps 68.

The fourth contact surfaces 65D of the first flaps 65 are inclined surfaces which are inclined to be increasingly distanced from the second conveyance route 28B toward the upstream in the second direction 72. The third contact surfaces 68C of the second flaps 68 are inclined surfaces which are inclined to be increasingly distanced from the second conveyance route 28B toward the upstream in the second direction 72. Thus, the recording sheet 12 is stably guided to the second conveyance route 28B by the fourth contact surfaces 65D of the first flaps 65 and the third contact surfaces 68C of the second flaps 68.

The switchback conveyance part 40 switches the conveyance direction of the recording sheet 12 from the first direction 71 to the second direction 72 in a state where the upstream end in the first direction 71 of the recording sheet 12 conveyed in the first direction 71 is in contact with the fourth contact surfaces 65D of the first flaps 65 and the third contact surfaces 68C of the second flaps 68. Bringing the recording sheet 12 conveyed in the second direction 72 into contact with the fourth contact surfaces 65D and the third contact surfaces 68C allows the recording sheet 12 to be stably guided to the second conveyance route 28B without any possibility that the first flaps 65 in the second state rotate to reach the first state and the second flaps 68 in the fourth state rotate to reach the third state.

The second conveyance route 28B is connected to the first conveyance route 28A at positions that are upstream and downstream of the recording unit 31 in the first direction 71. Thus, the recording sheet 12 passing through the second conveyance route 28B is conveyed to the recording unit 31 through the first conveyance route 28A in a state where the first surface and the second surface are reversed.

The first contact surfaces 65B of the first flaps 65 and the second contact surfaces 68B of the second flaps 68 make contact with the recording surface, of the recording sheet 12 conveyed in the first direction 71, on which the image has been recorded by the recording unit 31.

Modified Embodiment

The first flaps 65 and the second flaps 68 may not rotate under their own weight. The first flaps 65 and the second flaps 68 may rotate by the aid of urging means, such as springs.

The first support shaft 61A and the second support shaft 62A may be disposed to extend along the first direction 71 without any deviation. Or, the second support shaft 62A may be disposed upstream of the first support shaft 61A in the first direction 71. In that case, the positions at which the first flaps 65 make contact with the center 12A of the recording sheet 12 are made to be upstream, in the first direction 71, of the positions at which the second flaps 68 make contact with the both ends 12B of the recording sheet 12 by changing the shapes of the first flaps 65 and the second flaps 68.

When the switchback conveyance part 40 switches the conveyance direction of the recording sheet 12 from the first direction 71 to the second direction 72, the upstream end of the recording sheet 12 in the first direction 71 may not be brought into contact with the first flaps 65 and the second flaps 68. Namely, it may be configured such that the conveyance direction of the recording sheet 12 is switched from the first direction 71 to the second direction 72 in a state where the recording sheet 12 is separated from the first flaps 65 and the second flaps 68 in the first direction 71. In that case, the recording sheet 12 comes into contact with the first flaps 65 and the second flaps 68 when conveyed in the second direction 72, and then the recording sheet 12 is guided to the second conveyance route 28B while being brought into contact with the first flaps 65 and the second flaps 68.

What is claimed is:

1. An ink-jet recording apparatus configured to jet an ink on a sheet, comprising:

a body including a first conveyance route through which the sheet is conveyed in a first direction;

a recording unit disposed in the body and configured to record an image on the sheet conveyed through the first conveyance route in the first direction;

a switchback conveyance part configured to selectively convey the sheet to one side or the other side in the first direction in the first conveyance route;

a first flap configured to move between a first state in which the first flap guides, to the switchback conveyance part, the sheet conveyed to the one side in the first direction and a second state in which the first flap guides, from the first conveyance route to a second conveyance route, the sheet conveyed to the other side in the first direction by the switchback conveyance part; and second flaps disposed to sandwich the first flap in a second direction intersecting with the first direction and configured to move between a third state in which the second flaps guide, to the switchback conveyance part, the sheet conveyed to the one side in the first direction and a fourth state in which the second flaps guide, from the first conveyance route to the second conveyance route, the sheet conveyed to the other side in the first direction by the switchback conveyance part, wherein a portion of the first flap making contact with the sheet conveyed through the first conveyance route to the one side in the first direction is a first contact portion; a portion of each second flap making contact with the sheet conveyed through the first conveyance route to the one side in the first direction is a second contact portion; and the first contact portion is positioned on the other side in the first direction of each second contact portion;

a portion of each second flap making contact with the sheet conveyed to the other side in the first direction by the switchback conveyance part is a third contact portion; a portion of the first flap making contact with the sheet conveyed to the other side in the first direction by the switchback conveyance part is a fourth contact portion; and each third contact portion extends toward the second conveyance route beyond the fourth contact portion.

2. The ink-jet recording apparatus according to claim 1, wherein an end, of the first flap, on the other side in the first direction is rotatably supported by a first shaft, an end, of each second flap, on the other side in the first direction is rotatably supported by a second shaft, and the first shaft is positioned on the other side in the first direction of each second shaft.

3. The ink-jet recording apparatus according to claim 2, wherein the first contact portion of the first flap is an inclined surface which is inclined to be increasingly distanced from the first conveyance route toward the other side in the first direction, and the second contact portion of each second flap is an inclined surface which is inclined to be increasingly distanced from the first conveyance route toward the other side in the first direction.

4. The ink-jet recording apparatus according to claim 2, wherein the fourth contact portion of the first flap is an inclined surface which is inclined to be increasingly distanced from the second conveyance route toward the one side in the first direction, and the third contact portion of each second flap is an inclined surface which is inclined to be increasingly distanced from the second conveyance route toward the one side in the first direction.

5. The ink-jet recording apparatus according to claim 1, wherein the switchback conveyance part is configured to switch a conveyance direction of the sheet from the one side in the first direction to the other side in the first direction in a state where an end, of the sheet conveyed to the one side in the first direction, on the other side in the first direction is in contact with the fourth contact portion of the first flap in the second state and the third contact portion of each second flap in the fourth state.

6. The ink-jet recording apparatus according to claim 1, wherein the second conveyance route is connected to the first conveyance route on the one side and the other side in the first direction of the recording unit disposed on the first conveyance route.

7. The ink-jet recording apparatus according to claim 1, wherein the first contact portion of the first flap and the second contact portion of each second flap make contact with a recording surface, of the sheet conveyed to the one side in the first direction, on which the image has been recorded by the recording unit.

* * * * *